US008381873B2

(12) United States Patent
Cross et al.

(10) Patent No.: US 8,381,873 B2
(45) Date of Patent: Feb. 26, 2013

(54) LADDER AND SUPPORT STAND

(75) Inventors: Mark Cross, Marysville, MI (US); Eric Primeau, Burtchville, MI (US)

(73) Assignee: Affinity Tool Works, Troy, MI (US)

( * ) Notice: Subject to any disclaimer, the term of this patent is extended or adjusted under 35 U.S.C. 154(b) by 142 days.

(21) Appl. No.: 12/845,422

(22) Filed: Jul. 28, 2010

(65) Prior Publication Data

US 2011/0056764 A1 Mar. 10, 2011

Related U.S. Application Data

(60) Provisional application No. 61/229,005, filed on Jul. 28, 2009.

(51) Int. Cl.
*E06C 1/39* (2006.01)
*E04G 1/00* (2006.01)

(52) U.S. Cl. ..... 182/27; 182/163; 182/119

(58) Field of Classification Search ..... 182/27, 182/21, 118, 119, 163, 28; 403/93; 16/348, 16/233

See application file for complete search history.

(56) References Cited

U.S. PATENT DOCUMENTS

| | | | | | |
|---|---|---|---|---|---|
| 405,195 | A | * | 6/1889 | Ayres | 182/119 |
| 3,554,318 | A | * | 1/1971 | Knight | 182/24 |
| 4,493,392 | A | | 1/1985 | Alimbau Marques | |
| 4,519,476 | A | | 5/1985 | Alimbau Marques et al. | |
| 5,086,872 | A | | 2/1992 | Lin | |
| 5,358,069 | A | * | 10/1994 | Krause | 182/118 |
| D372,986 | S | * | 8/1996 | Oerther | D25/62 |
| 5,711,400 | A | * | 1/1998 | Tan | 182/119 |
| 7,044,498 | B2 | * | 5/2006 | Chen | 280/642 |
| 7,093,321 | B2 | | 8/2006 | Burbrink et al. | |
| 2005/0166364 | A1 | | 8/2005 | Lee | |
| 2007/0261916 | A1 | | 11/2007 | Sward et al. | |
| 2010/0071996 | A1 | * | 3/2010 | Huang | 182/118 |

* cited by examiner

*Primary Examiner* — Alvin Chin Shue

(74) *Attorney, Agent, or Firm* — Dickinson Wright PLLC

(57) ABSTRACT

A convertible ladder and scaffold assembly includes a plurality of uprights and a plurality of beams each extending from one of the uprights. A plurality of hinges each hingedly connect one of the uprights to one of the beams about a rotational axis ($A_R$) to provide an assembly having ladder, scaffold, push-cart, and storage configurations. Each of the hinges defines catches and present a stop releasably engaging catches for preventing rotation about the rotational axis ($A_R$). At least one lever bar releasably engages a plurality of the stops for simultaneously releasing a plurality of the stops from engaging catches. Each of the lever bars have a plurality of lever sections for providing leverage to disengage the stops from the catches. Each of the lever bars has a grip section interconnecting the lever sections for simultaneously releasing a plurality of the stops from engaging the catches.

14 Claims, 4 Drawing Sheets

LADDER AND SUPPORT STAND

CROSS REFERENCE TO RELATED APPLICATION

This application claims the benefit of provisional application Ser. No. 61/229,005 filed Jul. 28, 2009.

BACKGROUND OF THE INVENTION

1. Field of the Invention

A convertible ladder and scaffold assembly.

2. Description of the Prior Art

Convertible ladder and scaffold assemblies are well known in the prior art. US Patent Application Publication 2007/0261916 to Sward et al. discloses such an assembly having a plurality of uprights, a plurality of beams each extending from one of the uprights, and a plurality of hinges each hingedly connecting one of the uprights to one of the beams about a rotational axis. U.S. Pat. No. 5,086,872 to Lin discloses each of the hinges defining at least one catch and presenting a stop releasably engaging at least one of the catches for preventing rotation about the rotational axis.

SUMMARY OF THE INVENTION

The invention provides for at least one lever bar releasably engaging a plurality of the stops for simultaneously releasing a plurality of the stops from engaging the catches of a plurality of the hinges so the uprights can be moved relative to the beams. A handle is removably disposed to support and carry the ladder and scaffold assembly. Wheels are removably inserted into wheel holes defined by the hinges in the pushcart configuration for facilitating movement of the assembly and objects thereon.

ADVANTAGES OF THE INVENTION

The invention increases the number of stops a user can release at once. This reduces the difficulty in changing the configuration a ladder and scaffold assembly so it can be manipulated and adjusted in less time and with less effort. The handle is removably disposed in the assembly for flexibility in transporting the assembly. The assembly includes a storage compartment for storing the wheels and the wheels are installable in the hinges in the pushcart configuration of the assembly.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
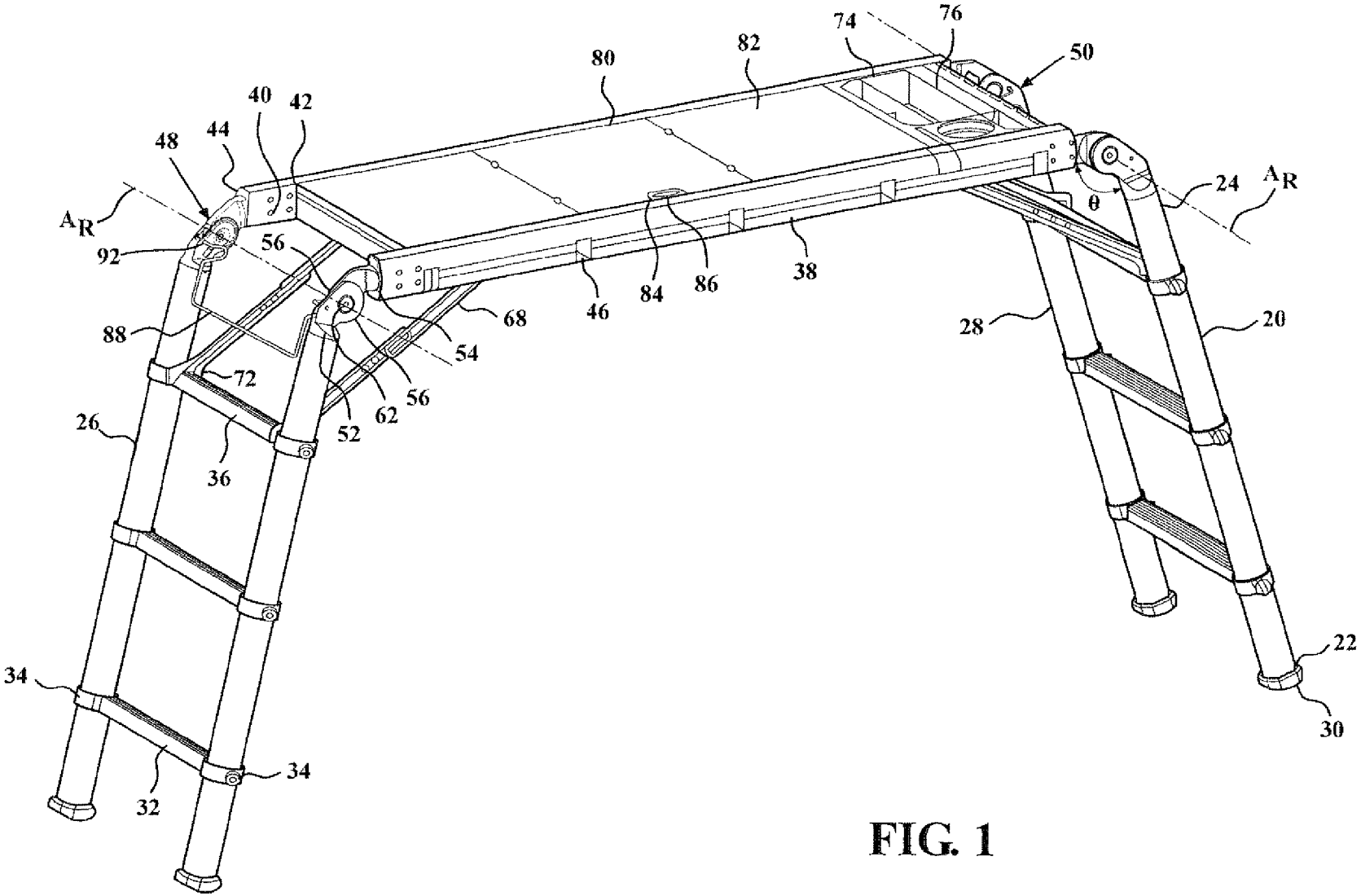
FIG. 1 is a perspective view of a convertible ladder and scaffold assembly in scaffold configuration in accordance with the present invention.
Figure 2:
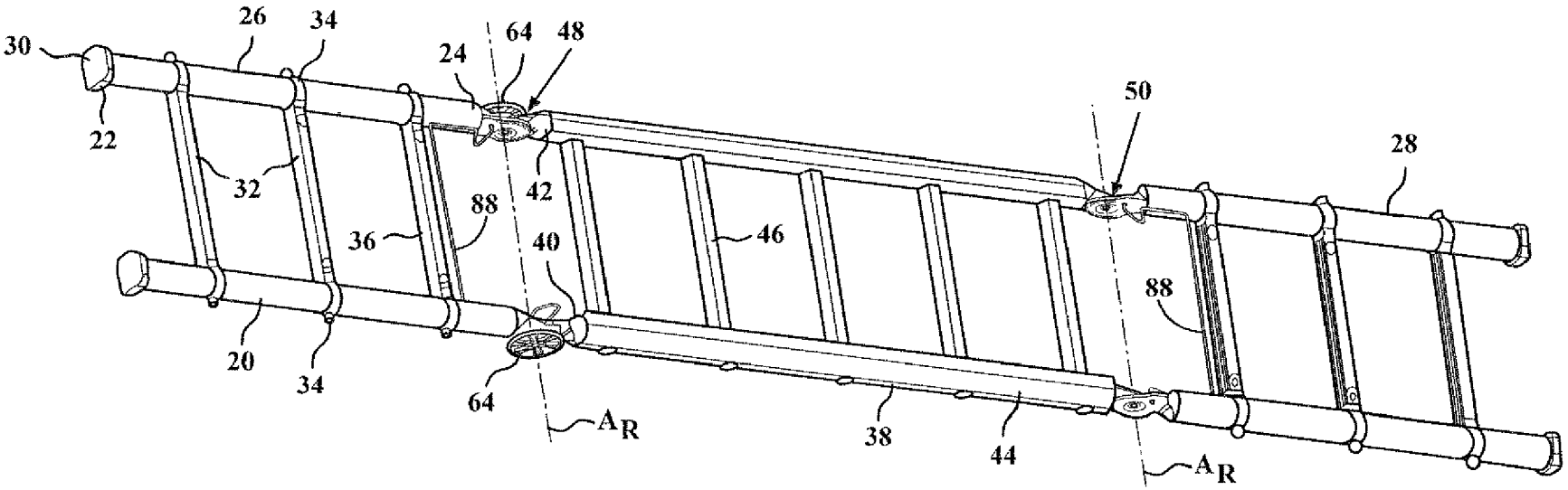
FIG. 2 is a perspective view of a convertible ladder and scaffold assembly in ladder configuration in accordance with the present invention.
Figure 3:
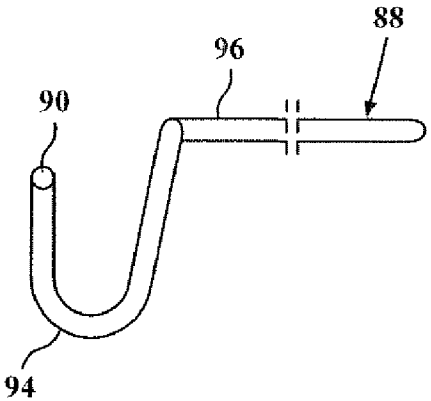
FIG. 3 is a side view of a lever bar in accordance with the present invention.
Figure 4:
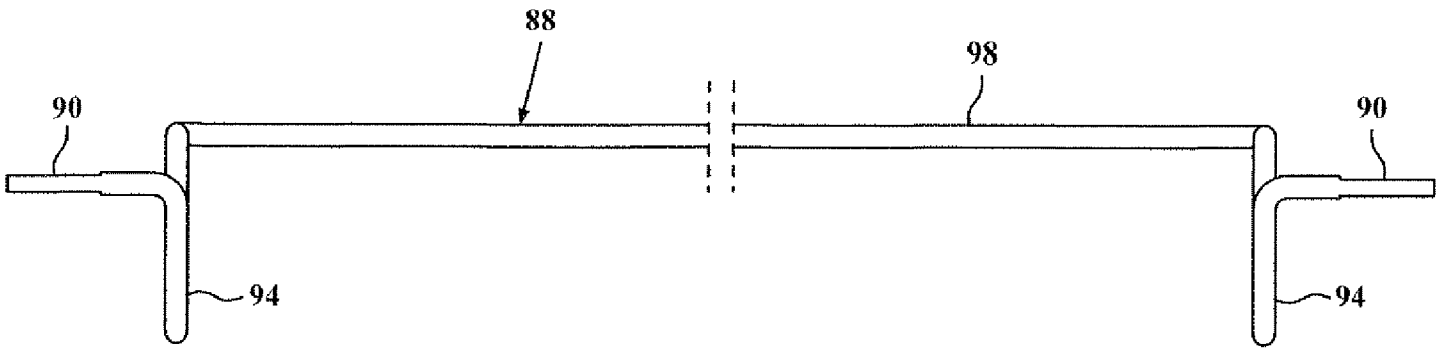
FIG. 4 is a front view of a lever bar in accordance with the present invention.
Figure 5:
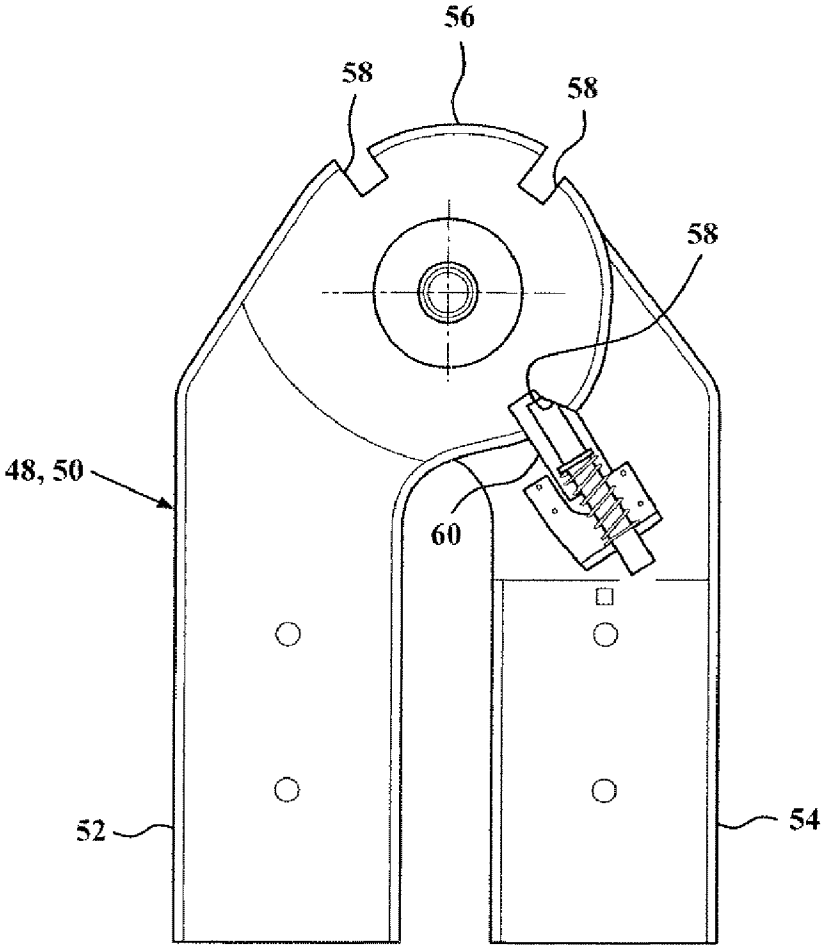
FIG. 5 is a cut-away view of a hinge in accordance with the present invention.

Referring to the Figures, wherein like numerals indicate corresponding parts throughout the several views, a convertible ladder and scaffold assembly includes a plurality of uprights 20. Each of the uprights 20 is tubular and extends between a distal end 22 and a proximal end 24. The uprights 20 are disposed in at least two upright pairs 26, 28. Each of the upright pairs 26, 28 includes two of the uprights 20 spaced from and parallel to each other. The upright pairs 26, 28 include a left upright pair 26 and a right upright pair 28. The right upright pair 28 is oppositely disposed and spaced from the left upright pair 26. A cap 30 encircles and covers the distal end 22 of each of the uprights 20.

A plurality of rungs 32 are spaced from one another along and between each of the uprights 20 of each of the upright pairs 26, 28. A plurality of rung ends 34 each encircle one of the uprights 20 and connects one of the rungs 32 to one of the uprights 20. The rungs 32 include a top rung 36 disposed adjacent the proximal ends 24 of the uprights 20 of each of the upright pairs 26, 28.

A pair of beams 38 are hollow and spaced from and parallel to each other. Each extends from one of the uprights 20 of the right upright pair 28 to one of the uprights 20 of the left upright pair 26. Each of the beams 38 has an inward wall 40 being flat and facing toward the other of the beams 38. Each of the beams 38 has a top wall 42 extending perpendicularly from the inward wall 40 and in a direction away from the other of the beams 38. Each of the beams 38 has a rounded wall 44 extending arcuately outward from and interconnecting the inward wall 40 and the top wall 42. A plurality of cross-pieces 46 are parallel to and evenly spaced from each other and extend perpendicularly between and connect the beams 38. The cross-pieces 46 are rectangular in cross-section.

A plurality of hinges 48, 50 each hingedly connect one of the uprights 20 to one of the beams 38 about a rotational axis $A_R$. Each of the hinges 48, 50 include an upright arm 52 having a circular cross-section and which is disposed within and secured to the proximal end 24 of one of the uprights 20. Each of the hinges 48, 50 include a beam arm 54 having a circular cross-section and which is disposed within and secured to one of the beams 38. Each of the arms 52, 54 extends to a leaf 56 having a circular perimeter. The leaves 56 of each hinge thereof rotatably connect the arms 52, 54 of the hinge thereof about the rotational axis $A_R$ and define an angle θ therebetween. The hinges 48, 50 include two left hinges 48 each secured to the uprights 20 of the left upright pair 26 and having the rotational axes $A_R$ thereof being coaxial. The hinges 48, 50 include two right hinges 50 secured to the uprights 20 of the right upright pair 28 and having the rotational axes $A_R$ thereof being coaxial.

Each of the leaves 56 of the hinges 48, 50 define a plurality of catches 58. Each of the hinges 48, 50 present a stop 60 being spring-loaded and releasably engaging at least one of the catches 58 for preventing rotation about the rotational axis $A_R$ thereof. The catches 58 and stops 60 of the hinges 48, 50 establish a scaffold configuration defined as the angle θ of each of the hinges 48, 50 being one hundred degrees whereby the beams 38 are horizontal for supporting workers and material at an elevated height. The catches 58 and stops 60 of the hinges 48, 50 establish a ladder configuration defined as the angle θ of each of the hinges 48, 50 being one hundred-eighty degrees whereby the beams 38 and uprights 20 are parallel for maximum reach of the assembly. The catches 58 and stops 60 of the hinges 48, 50 establish a pushcart configuration defined as the angle θ of the right hinges 50 being zero degrees and the angle θ of the left hinges 48 being ninety degrees whereby the right pair 28 and the left pair 26 are perpendicular for carrying work materials on one of the left pair 28 and said right pair 26. The catches 58 and stops 60 of the hinges 48, 50 establish a storage configuration defined as the angle θ of each of the hinges 48, 50 being zero degrees whereby said assembly is compact for storage.

The leaves 56 of each of the left hinges 48 define a plurality of wheel holes 62 extending therethrough. The wheel holes 62 of each of the left hinges 48 align in the pushcart configuration. A pair of wheels 64 each have an axle 66 (not shown). In the pushcart configuration, the axle 66 is removably disposed in the wheel holes 62 of one of the right hinges 50 and extending in a direction away from the opposite of the right hinges 50 for supporting and facilitating the movement of the assembly and objects resting thereon.

A plurality of braces 68 each have an anchor end 70 secured to one of the beams 38 and a divergent end 72 being U-shaped and resting on one of the top rungs 36. A tool tray 74 is removably disposed between the beams 38 and adjacent the right hinges 50 and defines storage pockets 76 and presents a plurality of electrical outlets 78.

A platform 80 is rectangular in shape and is removably disposed between the tool tray 74 and the left hinges 48. Each platform 80 defines a storage compartment internal thereof (not shown) for storing tools and materials and said wheels 64. Each platform 80 presents an upper surface 82 having an anti-slip diamond pattern and defines a handle pocket 84. A work clamp (not shown) removably engages the upper surface 80 for clamping materials. A handle 86 is removably disposed within the handle pocket 84 for carrying the ladder and platform 80 assembly.

At least one lever bar 88 releasably engages a plurality of the stops 60 for simultaneously releasing a plurality of the stops 60 from engaging the catches 58 of a plurality of the hinges 48, 50. One of the lever bars 88 interconnects each of the right hinges 50 and another of the lever bars 88 interconnects each of the left hinges 48.

Each of the lever bars 88 extends between two lever ends 90. One of the leaves 56 of each of the hinges 48, 50 defines a lever hole 92 parallel to and radially spaced from the rotational axis $A_R$ and one of the lever ends 90 is rotatably disposed therein. Each of the lever bars 88 has a plurality of contact sections 94 each extending arcuately from and perpendicular to one of the lever ends 90 and engaging one of the stops 60. Each of the lever bars 88 has a plurality of lever sections 96 each extending straight from one of the contact sections 94 in a direction radially away from the lever ends 90 for providing leverage to disengage the stops 60 from the catches 58. Each of the lever bars 88 has a grip section 98 interconnecting the lever sections 96 for simultaneously releasing a plurality of the stops 60 from engaging the catches 58. In use, the lever bars 88 are rotated to release the stops 60 from engaging the catches 58 so the assembly can be reconfigured between the scaffold, ladder, push-cart and storage positions.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. A convertible ladder and scaffold assembly comprising:

a plurality of uprights (20), a plurality of beams (38) each extending from one of said uprights (20), a plurality of hinges (48, 50) each hingedly connecting one of said uprights (20) to one of said beams (38) about a rotational axis ($A_R$), each of said hinges (48, 50) defining at least one catch (58) and presenting a plurality of stops (60) releasably engaging said at least one catche (58) for preventing rotation about said rotational axis ($A_R$), and at least one lever bar (88) releasably engaging a plurality of said stops (60) for simultaneously releasing a plurality of said stops (60) from engaging said at least one catche (58) of a plurality of said hinges (48, 50), said at least one lever bar (88) extending between two lever ends (90) and each of said hinges (48, 50) defines a lever hole (92) and one of said lever ends (90) is rotatably disposed therein, said at least one lever bar (88) has a plurality of lever sections (96) each extending in a direction radially away from said lever ends (90) for providing leverage to disengage said stops (60) from said at least one catch (58), said at least one lever bar (88) having a grip section (98) interconnecting said lever sections (96) for simultaneously releasing a plurality of said stops (60) from engaging said catches (58), said at least one lever bar (88) having a plurality of contact sections (94) each extending arcuately and engaging one of said stops (60).

2. An assembly as set forth in claim 1 wherein said uprights (20) are disposed in at least two upright pairs (26, 28) with each said upright pair (26, 28) including two of said uprights (20) spaced from and parallel to each other and said upright pairs (26, 28) include a left upright pair (26) and a right upright pair (28) with said right upright pair (28) oppositely disposed and spaced from said left upright pair (26).

3. An assembly as set forth in claim 2 wherein said hinges (48, 50) include two left hinges (48) each secured to said uprights (20) of said left upright pair (26) and having said rotational axes ($A_R$) thereof being coaxial and two right hinges (50) secured to said uprights (20) of said right upright pair (28) and having said rotational axes ($A_R$) thereof being coaxial.

4. An assembly as set forth in claim 3 further including first (88) and second lever bars (98) said first lever bars (88) interconnects each of said right hinges (50) and said second lever bar (98) interconnects each of said left hinges (48).

5. An assembly as set forth in claim 1 wherein each of said uprights (20) are tubular and extend between a distal end (22) and a proximal end (24) and a cap (30) encircles and covers said distal end (22) of each of said uprights (20).

6. An assembly as set forth in claim 1 wherein said beams (38) are hollow and spaced from and parallel to each other and each extends from one of said uprights (20) of said right upright pair (28) to one of said uprights (20) of said left upright pair (26) and each of said beams (38) have an inward wall (40) being flat and facing toward the other of said beams (38) and a top wall (42) extending perpendicularly from said inward wall (40) and in a direction away from the other of said beams (38) and a rounded wall (44) extending arcuately outward from and interconnecting said inward wall (40) and said top wall (42).

7. An assembly as set forth in claim 6 wherein each of said hinges (48, 50) includes an upright arm (52) having a circular cross-section and disposed within and secured to said proximal end (24) of one of said uprights (20) and each of said hinges (48, 50) includes a beam arm (54) having a circular cross-section and disposed within and secured to one of said beams (38) and each of said arms (52, 54) extends to a leaf (56) having a circular perimeter and said leaves (56) of each said hinge thereof rotatably connect said arms (52, 54) of said hinge thereof about said rotational axis ($A_R$) and define an angle (Θ) therebetween.

8. An assembly as set forth in claim 1 including a plurality of rungs (32) spaced from one another along and between each of said upright pairs (26, 28) and a plurality of rung ends (34) each encircling one of said uprights (20) and connecting one of said rungs (32) to one of said uprights (20) and said rungs (32) including a top rung (36) disposed adjacent said proximal ends (24) of said uprights (20) of each of said upright pairs (26, 28).

9. An assembly as set forth in claim 1 including a plurality of cross-pieces (46) being parallel to and evenly spaced from each other and extending perpendicularly between and connecting said beams (38) and being rectangular in cross-section.

10. An assembly as set forth in claim 1 wherein said leaves (56) of each of said left hinges (48) define a plurality of wheel holes (62) extending therethrough and said wheel holes (62) of each said left hinges (48) are in alignment in said pushcart configuration and including a pair of wheels (64) each having an axle (66) removably disposed in said wheel holes (62) of one of said left hinges (48) and extending in a direction away from the opposite of said left hinges (48) for supporting and facilitating the movement of the assembly and objects resting thereon.

11. An assembly as set forth in claim 1 including a plurality of braces (68) each having an anchor end (70) secured to one of said beams (38) and a divergent end (72) being U-shaped and resting on one of said top rungs (36).

12. An assembly as set forth in claim 3 including a tool tray (74) removably disposed between said beams (38) and adjacent said right hinges (50) and defining storage pockets (76) and presenting a plurality of electrical outlets (78).

13. An assembly as set forth in claim 1 including a platform (80) being rectangular in shape disposed between said tool tray (74) and said left hinges (48) and defining a handle pocket (84).

14. An assembly as set forth in claim 13 including a handle (86) disposed within said handle pocket (84) for carrying said ladder and platform assembly.

* * * * *

UNITED STATES PATENT AND TRADEMARK OFFICE

CERTIFICATE OF CORRECTION

PATENT NO. : 8,381,873 B2
APPLICATION NO. : 12/845422
DATED : February 26, 2013
INVENTOR(S) : Mark Cross et al.

It is certified that error appears in the above-identified patent and that said Letters Patent is hereby corrected as shown below:

In the Specification

Column 4, Line 11 “catche” should read --catch--.

Signed and Sealed this
Twentieth Day of May, 2014

Michelle K. Lee

Michelle K. Lee
*Deputy Director of the United States Patent and Trademark Office*